US010912389B2

(12) United States Patent
Plouffe

(10) Patent No.: US 10,912,389 B2
(45) Date of Patent: Feb. 9, 2021

(54) STADIUM SEAT TABLE

(71) Applicant: Richard Plouffe, Orlando, FL (US)

(72) Inventor: Richard Plouffe, Orlando, FL (US)

(73) Assignee: Richard Plouffe, Ponte Vedra, FL (US)

( * ) Notice: Subject to any disclaimer, the term of this patent is extended or adjusted under 35 U.S.C. 154(b) by 0 days.

(21) Appl. No.: 16/420,926

(22) Filed: May 23, 2019

(65) Prior Publication Data

US 2019/0357689 A1 Nov. 28, 2019

Related U.S. Application Data

(60) Provisional application No. 62/676,296, filed on May 25, 2018.

(51) Int. Cl.

| | |
|---|---|
| ***A47C 7/70*** | (2006.01) |
| ***A47B 13/16*** | (2006.01) |
| ***A47B 13/08*** | (2006.01) |

(52) U.S. Cl.

CPC ..... *A47C 7/705* (2018.08); *A47B 13/083* (2013.01); *A47B 13/16* (2013.01)

(58) Field of Classification Search

CPC ..... A47C 7/705; A47C 7/68; A47B 3/063; A47B 13/083; A47B 13/16

See application file for complete search history.

(56) References Cited

U.S. PATENT DOCUMENTS

| | | | | | |
|---|---|---|---|---|---|
| 2,954,955 | A | * | 10/1960 | Feller | A47C 7/68 248/231.41 |
| 4,300,798 | A | * | 11/1981 | Musgrove | A47C 7/68 297/162 |
| 5,038,451 | A | * | 8/1991 | Smith | A47C 4/04 29/434 |
| 5,573,301 | A | * | 11/1996 | Scott | A47C 7/68 297/170 |
| 5,653,499 | A | * | 8/1997 | Goodall | A47C 7/70 297/170 |
| 5,720,516 | A | * | 2/1998 | Young | A47C 7/68 297/188.14 |
| 5,909,864 | A | * | 6/1999 | Wang | A47C 7/68 248/284.1 |
| 6,142,559 | A | * | 11/2000 | Sorel | A47C 7/70 108/48 |

(Continued)

FOREIGN PATENT DOCUMENTS

| | | | | | |
|---|---|---|---|---|---|
| CA | 2327562 | A1 | * | 7/2001 | F16M 11/048 |
| FR | 1298486 | A | * | 7/1962 | A47C 7/68 |

*Primary Examiner* — Timothy J Brindley

(57) ABSTRACT

The present invention relates to an adjustable stadium seat table. The adjustable table comprises a tray, a trey bracket, riser assembly, a horizontal assembly, a seat bracket and a 90 degree angle bracket. The horizontal assembly comprises an outer tube and an inner tube. The seat bracket is configured to hold the outer tube of the horizontal assembly underneath a seat. The tray of the adjustable table includes a slot and an opening. The slot on the tray accommodates a cell phone and the opening holds a cup comprising a drink. The tray is engaged to the inner tube tray via the tray bracket, wherein the tray bracket is bonded to the tray underneath. Further, the tray bracket enables the tray to rotate at 90°. The tray and the riser assembly are stored under the seat and is retrieved by arena personnel once the event is over.

19 Claims, 6 Drawing Sheets

(56) References Cited

U.S. PATENT DOCUMENTS

| | | | | |
|---|---|---|---|---|
| 8,651,569 | B2 * | 2/2014 | Andoloro | A47C 1/0342 297/195.11 |
| 9,681,755 | B1 * | 6/2017 | Schober | A47C 7/68 |
| 2004/0041446 | A1 * | 3/2004 | Onishi | A47C 9/002 297/170 |
| 2011/0031785 | A1 * | 2/2011 | Steenson | A47C 7/546 297/161 |
| 2015/0069797 | A1 * | 3/2015 | Goldberg | A47C 7/68 297/135 |
| 2017/0208952 | A1 * | 7/2017 | Simon | A47C 7/004 |
| 2018/0255932 | A1 * | 9/2018 | Hopper | A47C 9/005 |
| 2019/0159600 | A1 * | 5/2019 | Sartor | A47C 1/124 |

* cited by examiner

SECTION B-B

STADIUM SEAT TABLE

BACKGROUND OF THE INVENTION

A. Technical Field

The present invention generally relates to an adjustable table used in an arena or a stadium. The concept along with the device allows the patron to obtain the food from the concession stand and navigate back to their seat with some degree of safety for the patron as well as the food. Once at their seat the table and supporting devices allow the patron to enjoy the food and beverage in a comfortable environment.

B. Description of Related Art

In the present day, people gather in stadiums and arenas to be entertained for a multitude of events, including baseball games, football games, and car races. Some stadiums or arenas provide benches and others provide individual seats which are positioned close to each other in which the viewers sit. The seating arrangement in the stadium is not designed for comfort, but to maximize the capacity of the stadium. Therefore, the amount of space provided for each of the viewers to watch the event is generally small.

The stadiums in the modern era are large and designed to hold as many people as possible. The viewers attending the events at the stadiums require food and drink since the concept of the stadium was introduced by the Greeks for their games. However, the stadium constructed in the past as well as in the present days do not provide a table or surface on which the items are placed while the viewer is being seated. The viewers often consume food and beverages while watching the events in the stadium although the seating is tightly spaced. However, it is difficult and/or uncomfortable to balance or manage food and beverages in the allotted space.

Further, the modern stadiums do not allow the viewers to carry food and drink inside the stadium for security concerns and other considerations. The viewers need to purchase their beverages and food from the on-site vendors and take the items back to their seats. Once the viewer has their beverages and food in hand, and back in their seat, another problem arises. Due to the limited area of the stadium seating, finding a spot to place the food and drink becomes a real issue. Many people set their drink on the floor next to their seat. This usually results in accidentally spillage of the food items by the people traversing through the walkway and seats. In some scenarios, the viewers might themselves knock down the food items unknowingly, forgetting that the food items are placed on the floor closer to their seat. To overcome, the above issue, the viewer may place the food items up in his or her lap or held in the hand until consumed or disposed of. Eating and drinking at a sporting or other popular event is a challenge that few people can navigate without some difficulty.

The concession stand serves the food and drink to the viewer as individual servings. The viewer needs to struggle to carry the items to their seat as they pass through the stair case holding the items in their hands. Further, a flimsy cardboard tray is provided to the viewer. If the viewer is purchasing multiple drinks and food for several people, these cardboard carriers can droop if not supported with both the hands. In an event, when the viewer has to hold a railing for support for climbing the stairs to prevent sudden fall a significant part of their purchase is wasted, due to spillage of the items on the floor as the viewer is not able to hold the cardboard with both the hands. Moreover, the items purchased could get spilt on the neighbors which could spoil the clothes and mood of the neighbor due to sudden spillage of the items.

In light of the forgoing discussion, there exists a need for an adjustable table, that resolves the aforementioned issues. Further, there is a need for a Stadium seat table that provides a surface to hold one or more items allowing the viewer to enjoy the event without any disturbances.

SUMMARY OF THE INVENTION

The present invention relates to an adjustable stadium seat table. The adjustable stadium seat table of the present invention provides a solution to eating and drinking issues during the event.

In an embodiment, the adjustable table comprises an upper unit and a lower unit. In an embodiment, the adjustable table comprises a tray, a trey bracket, riser assembly, a horizontal assembly, a seat bracket and a 90 degree angle bracket. The tray and trey bracket form the upper unit of the adjustable table. The lower unit includes the riser assembly, the horizontal assembly and the seat brackets and the 90 degree angle bracket. The reusable, heavy duty tray is used to safely transport drinks and food back to the user's seat. Upon arrival at the seat, the tray is mounted on the riser assembly and adjusted to provide an optimum support of the user's food, drink, and cell phone. In an embodiment, the riser assembly of the present invention is configured to hold the tray. The horizontal assembly comprises an outer tube and an inner tube. The outer tube and inner tube is designed to fit snugly within the seat brackets. It consists of 6005A-T6 aluminum alloy, 1.25 OD and 1.50" OD extruded square tubing with 0.020 wall thickness. The 1.25" tubing is the inner tube which snugly fits within the 1.50" tubing which is the outer tube. A spring-loaded button in the outer tube is configured to secure the two tubes at any extended position. The riser assembly has a right-angle fitting that is 1.25" ID and the tray fitting has a rectangular locking plate attached to the rotating fitting. Each of these are manufactured using various aluminum alloys.

In an embodiment, the riser assembly further comprises an angle bracket. The angle bracket is configured to engage the inner tube. The angle bracket is cast using A356 aluminum alloy in a permanent mold. The angle bracket is pinned to the horizontal tubing i.e. inner tube, while accepting the vertical tubing. The outer tube is held in place underneath the seat by the seat brackets. In an embodiment, the outer tube is held by the two seat brackets. The two seat brackets are stamped from 6061 aluminum alloys, 12 gauges (0.081") thick, sheet stock. The seat brackets are stamped to accept the 1.50" square outer tube of the horizontal assembly. The seat brackets are secured to the base of the pivoting plastic seat via one or more fasteners. The fasteners are for example but not limited to oval head carriage bolts. In an embodiment, the seat brackets are offset to a left side of the seat allowing the riser assembly to rest against the side of a leg of the user, when installed and allowing the user to stand when the tray is rotated outward at an angle of about 90°.

In an embodiment, the tray is commercially available tray which is 12" long by 8" wide by 1" high. The tray is injection molded from a food grade plastic material. The plastic material is for example but not limited to polypropylene. The food grade plastic material of the present invention is Bisphenol A (BPA) free plastic material. Further the plastic material is very durable, impervious to household and cleaning chemicals and highly resistant to UV degradation. In an embodiment, the tray includes a slot and an opening or a hole. The slot on the tray accommodates a cell phone and hence functions as a cell phone stand. The opening is a drink or cup holder that holds a plastic cup. The tray is held by the riser assembly via the tray bracket. The tray bracket is an offset connector that is adhesively bonded to the tray underneath.

In one embodiment, the tray bracket includes a retaining plate, an outer ring and an inner ring. The retaining plate is stamped from 6061 aluminum alloy sheet which is then secured to the cast outer ring using spool gun MIG welding. The cast inner ring is secured to the square tubing connector using the MIG welding techniques. An interior surface of the outer ring is slotted to accept a snap ring to hold the two rings together and allowing them to rotate independently. In one embodiment, the outer ring is drilled in multiple locations or places to accept a spring-loaded rotation button mounted on the inner ring, locking them in place. In one embodiment, a tray receptacle accepts the metal plate which allows it to slide in such a manner that the sides of the tray capture it. In an embodiment, one or more buttons have enough compliance to prevent the metal plate from inadvertently sliding out. The metal plate could be easily removed for easy return of the tray to a concession stand.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For illustrating the invention, exemplary constructions of the invention are shown in the drawings. However, the invention is not limited to the specific methods and structures disclosed herein. The description of a method steps or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1A:
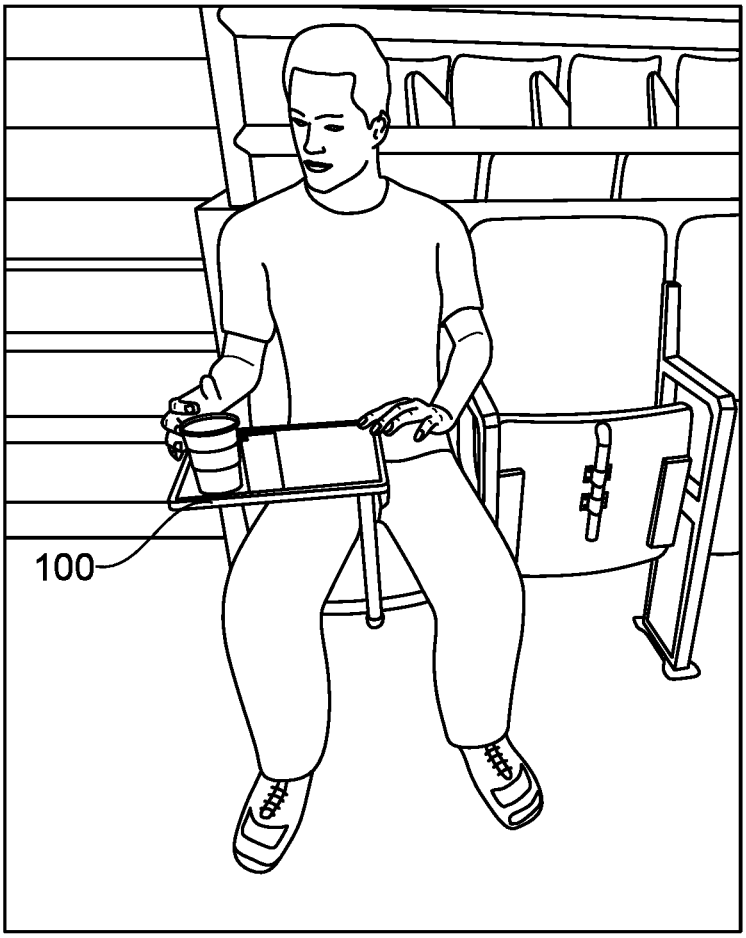
FIG. 1A is a perspective view illustrating an adjustable table in its upright form along with a user seated by the adjustable table in a stadium seating arrangement, according to an embodiment of the present invention.

Referring to FIG. 1A, a perspective view illustrating an adjustable stadium seat table 100 in its upright form, seated by a user is illustrated, according to an embodiment of the present invention.

Figure 1B:
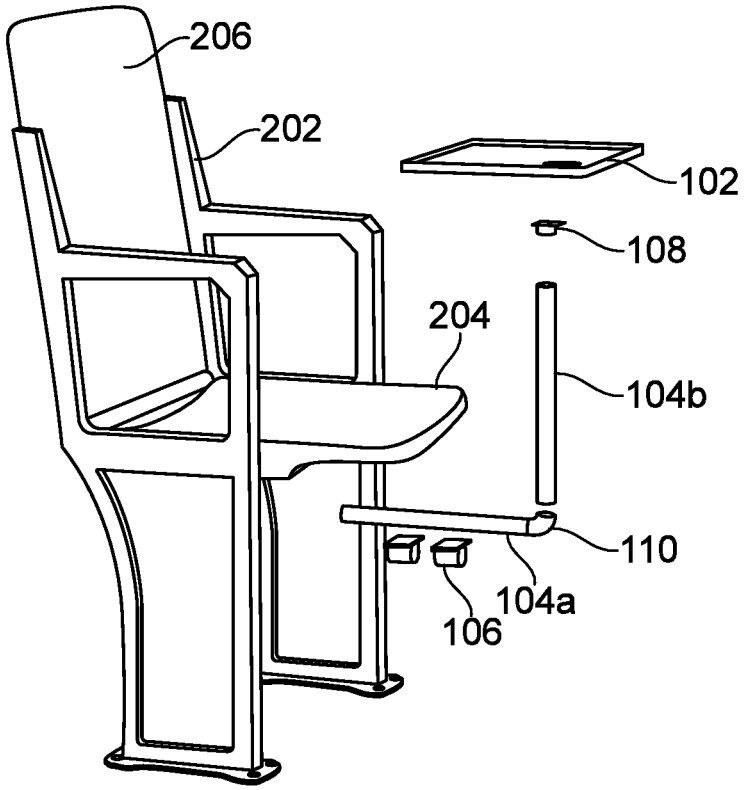
FIG. 1B is an exploded view of the adjustable table, according to an embodiment of the present invention.

Referring to FIG. 1B, the adjustable table 100 comprises an upper unit and a lower unit. In an embodiment, the adjustable table 100 comprises a tray 102, riser assembly or vertical tubing/tube 104*b*, a seat bracket 106, the horizontal assembly 104, a connector 108 and the 90 degree angle bracket 110. The present invention provides a solution to eating and drinking issues during a big event at the. The reusable, heavy duty tray 102 is used to safely transport drinks and food back to the user's seat. Upon arrival at the seat, the tray 102 is mounted on the riser assembly or vertical tubing/tube 104*b* to provide an optimum support of the user's food, drink, and cell phone. Further, the adjustable table 100 provides a surface to hold one or more items such as food, drink, and cell phone allowing the user to enjoy the event without any disturbances.

In one embodiment, the riser assembly further comprises an angle bracket 110. The angle bracket 110 is configured to connect or join or engage the inner tube 104*c* (shown in FIG. 2A). The angle bracket 110 is cast using A356 aluminum alloy in a permanent mold. The angle bracket 110 is pinned to the horizontal tubing 104*a* i.e. inner tube 104*c* (shown in FIG. 2A), while accepting the vertical tubing/tube 104*b*. The horizontal tubing 104*a* is held in place underneath the seat by the seat brackets 106. In an embodiment, the horizontal tubing 104*a* is held by the two seat brackets 106. However, there could be more than two seat brackets 106 located beneath the seat for holding the horizontal tubing 104*a*. The two seat brackets 106 are stamped from 6061 aluminum alloys, 12 gauges (0.081") thick, sheet stock. The seat brackets 106 are stamped to accept the 1.50" square horizontal tubing 104*a* of the horizontal assembly 104. The seat brackets 106 are secured to the base of the pivoting plastic seat 204 via one or more fasteners. The fasteners are for example but not limited to oval head carriage bolts. In an embodiment, the seat brackets 106 are offset to a left side of the seat 204 allowing the riser assembly to rest against the side of a leg of the user, when installed and allowing the user to stand when the tray 102 is rotated outward at an angle of about 90°.

In an embodiment, the tray 102 is commercially available tray which is 12" long by 8" wide by 1" high. The tray 102 is injection molded from a food grade plastic material. The plastic material is for example but not limited to polypropylene. The plastic material could be any type of food grade plastic material that serves the purpose of the present invention. The food grade plastic material of the present invention is Bisphenol A (BPA) free plastic material. Further the plastic material is very durable, impervious to household and cleaning chemicals and highly resistant to UV degradation. The tray 102 could be supplied in almost any vibrant color, such that a distinctive color is chosen to enhance the product recognition factor, to improve the market adoption of the product. In an embodiment, the tray 102 comprises a slot 114 and an opening or a hole 126. The slot 114 on the tray 102 accommodates a cell phone and hence functions as a cell phone stand. The opening 126 is a drink or cup holder that holds a plastic cup. The tray 102 is held by the riser assembly via the tray bracket 108. The tray bracket 108 fitting is offset to allow the adjustable table 100 to be to either to the left side or right side of the user. Further, the tray bracket 108 is adhesively bonded to the tray 102 underneath. The tray 102 is normally supplied in one of fourteen standard colors or could be supplied in a special-order color. Further, the size of the tray 102 is not limited to the size mentioned above. It could be of any size that serves the purpose of the present invention. The tray 102 is available in the concession stand within the stadium.

Figure 1C:
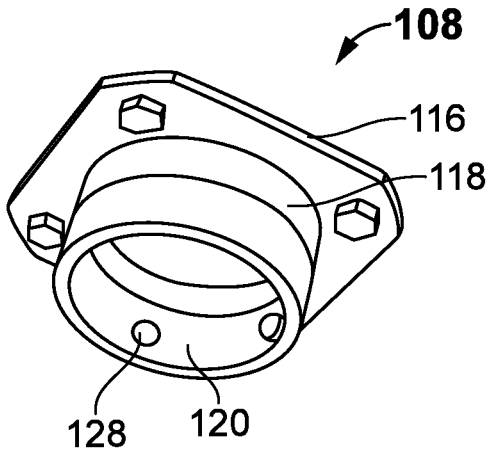
FIG. 1C exemplarily illustrates a tray bracket, according to an embodiment of the present invention.

FIG. 1C exemplarily illustrates the tray bracket 108, according to an embodiment of the present invention. In an embodiment, the tray bracket 108 is manufactured in three pieces using A356 aluminum alloy. The tray bracket or the connector 108 includes a retaining plate 116, an outer ring 118 and an inner ring 120. The retaining plate 116 is stamped from 6061 aluminum alloy sheet which is then secured to the cast outer ring 118 using spool gun MIG welding. The cast inner ring 120 is secured to the square tubing connector using the MIG welding techniques. An interior surface of the outer ring 118 is slotted to accept a snap ring to hold the two rings together and allowing them to rotate independently. In one embodiment, the outer ring 118 is drilled in multiple locations or places to accept a spring-loaded rotation button 128 mounted on the inner ring 120, locking them in place which is easy to depress, and rotate the tray 102. In an embodiment, each of the aluminum components are vibrationally deburred, cleaned, anodized, and dyed after assembly. The process of anodizing the aluminum components hardens the aluminum surface to provide a scratch resistant surface during use.

Figure 2A:
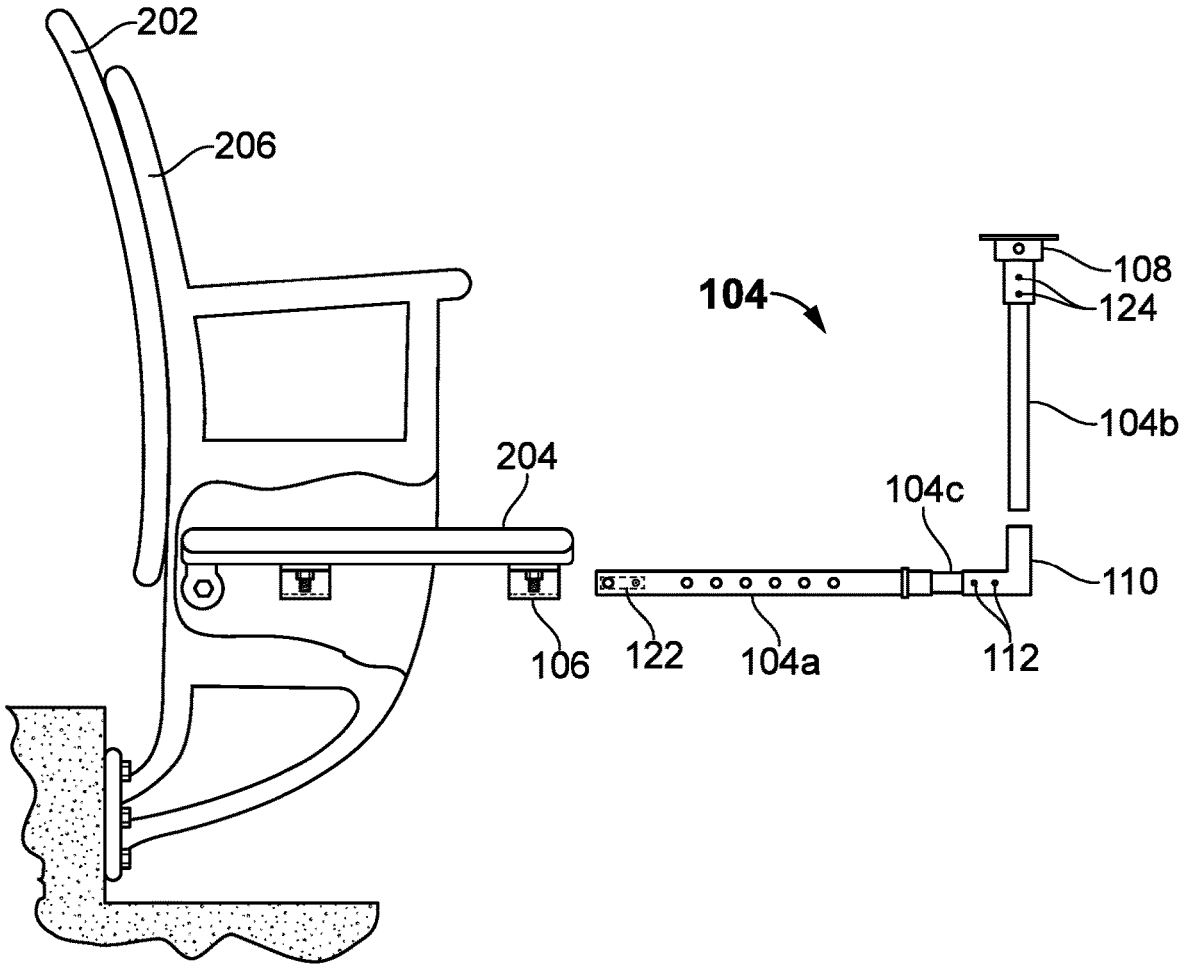
FIG. 2A is an exploded view of the lower unit of the adjustable table, according to an embodiment of the present invention.

Referring to FIG. 2A, an exploded view of the lower unit of the adjustable table 100 is illustrated, according to an embodiment of the present invention. In an embodiment a cast metal seat frame 202 is secured to a step riser, while the molded plastic seat 204, and back 206 are attached to the frame 202. The horizontal assembly 104 is fastened to the seat brackets 106. The seat brackets 106 are secured to the bottom of the seat 204 via the fasteners such as an oval head carriage bolts through the seat 204. The seat brackets 106 and fasteners allow retro-fitting this invention to any stadium in a country. The tray 102 and the tray bracket 108 fitting is secured to the riser assembly using one or more drive pins 124. The drive pins 124 also holds the rotating ring i.e. the outer ring 118 and the inner ring 120, and its retaining plate 116 at the proper orientation at the end of the inner tube 104*c*. The angle bracket 110 is cast using a permanent mold and molten metal process after which it is vibrationally deburred, anodized and dyed, then is secured to the horizontal tubing 104*a* i.e. the inner tube 104*c* via the drive pins 112.

Figure 2B:
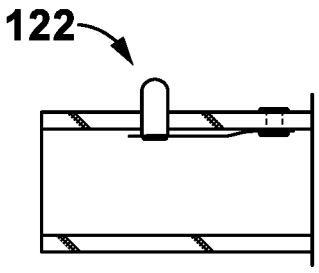
FIG. 2B exemplarily illustrates a view of a spring-loaded button on an outer tube, according to an embodiment of the present invention.

Referring to FIG. 2B, a view of a spring-loaded button 122 on the horizontal tubing 104*a* is illustrated, according to an embodiment of the present invention. The button 122 is spring loaded using a spring steel ribbon pop riveted to the bull nose button, which is depressed to release it from the inner tube 104*c* (shown in FIG. 2A). The outer horizontal tubing 104*a* in stationary. The inner tube 104*c* (shown in FIG. 2A) is used to adjust the position of the riser assembly and table.

Figure 2C:
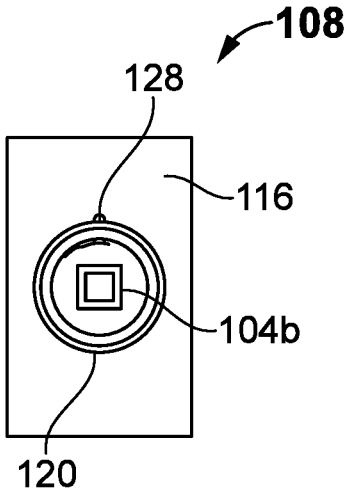
FIG. 2C exemplarily illustrates an attachment of the tray bracket to a bottom portion of the tray according to an embodiment of the present invention.
Figure 2D:
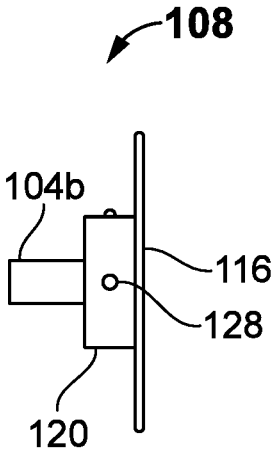
FIG. 2D exemplarily illustrates a side view of the tray bracket, according to an embodiment of the present invention.

Referring to FIG. 2C, an attachment of the tray bracket 108 to a bottom portion of the tray 102 is illustrated, according to an embodiment of the present invention. The track bracket 108 is bonded or mounted underneath or to the bottom portion of the tray 102. The retaining plate 116 is secured to the outer ring 118 with MIG welds. The interior surface of the outer ring 118 is slotted to accept the snap ring to hold the two rings together and allowing them to rotate independently. Further, the outer ring 118 is drilled in multiple locations or places to accept the spring-loaded rotation buttons 128 mounted on the inner ring 120, locking them in place. Referring to FIG. 2D, a side view of the tray bracket 108 is illustrated, according to an embodiment of the present invention.

Figure 3A:
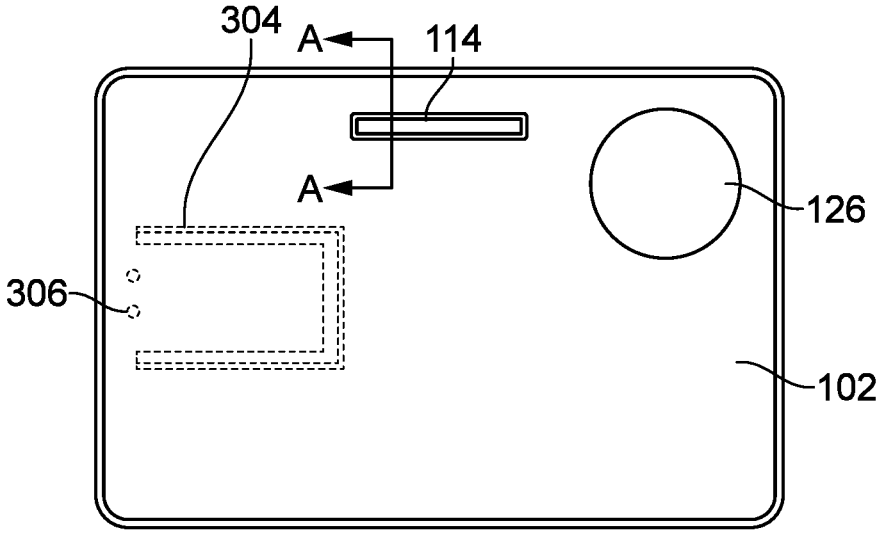
FIG. 3A exemplarily illustrates a top view of the tray, according to an embodiment of the present invention.
Figure 3B:
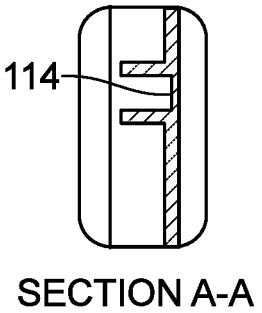
FIG. 3B exemplarily illustrates a cross sectional view of a slot on the tray along a section A-A' of FIG. 3A, according to an embodiment of the present invention.
Figure 3C:
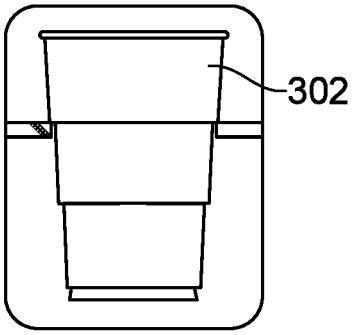
FIG. 3C exemplarily illustrates the tray holding a cup, according to an embodiment of the present invention.
Figure 3D:
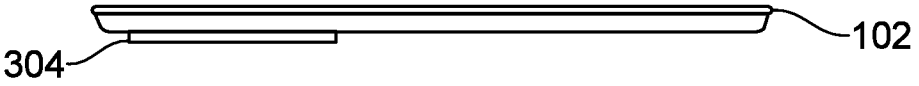
FIG. 3D exemplarily illustrates a side view of the tray, according to an embodiment of the present invention.

Referring to FIG. 3A, a top view of the tray 102 is illustrated, according to an embodiment of the present invention. The food service tray 102 is 1.0" deep for easy stacking. An upper surface of the tray 102 is textured to reduce the sliding around of the food service containers. Referring to FIG. 3B, a cross sectional view of the slot 114 on the tray 102 along a section A-A' of FIG. 3A is illustrated. The 0.6" by 4.0" wide slot 114 accommodates the cellular phones comprising a protective guard. The side walls of the slot 114 are about 0.50" tall, which enables the slot 114 to hold the phone erect for easy use or watching video of the event. In an alternate embodiment, the dimension of the slot 114 could be adjusted if the manufacturer wants to make the slot 114 work with all handheld devices, for example, the cell phone, the tablet, etc. Referring to FIG. 3C, the tray 102 holding the cup 302 is illustrated, according to an embodiment of the present invention. The cup 302 rests on a rim of the opening or hole 126 molded into the tray 102 and is about 3.25" in diameter at the first step. The hole or the opening 126 in the tray 102 is 3.25" in diameter which loosely captures the cup 302 at the 12-ounce line, preventing any spills during transportation and use. The standard cup 302 at a concession stand holds 16 ounces of liquid when filled to the rim and 12 ounces when filled to a first step below the rim, which is done to reduce spillage during transportation back to the seat 204. Referring to FIG. 3D, a side view of the tray 102 is illustrated, according to an embodiment of the present invention. The rim of the tray 102 is rounded and is rolled over with the lip to improve the strength, such that the tray 102 do not flex when held at one corner or one end, preventing spillage of the food or beverage. The height of the lip is such that it reduces any spillage from the tray 102.

Figure 3E:
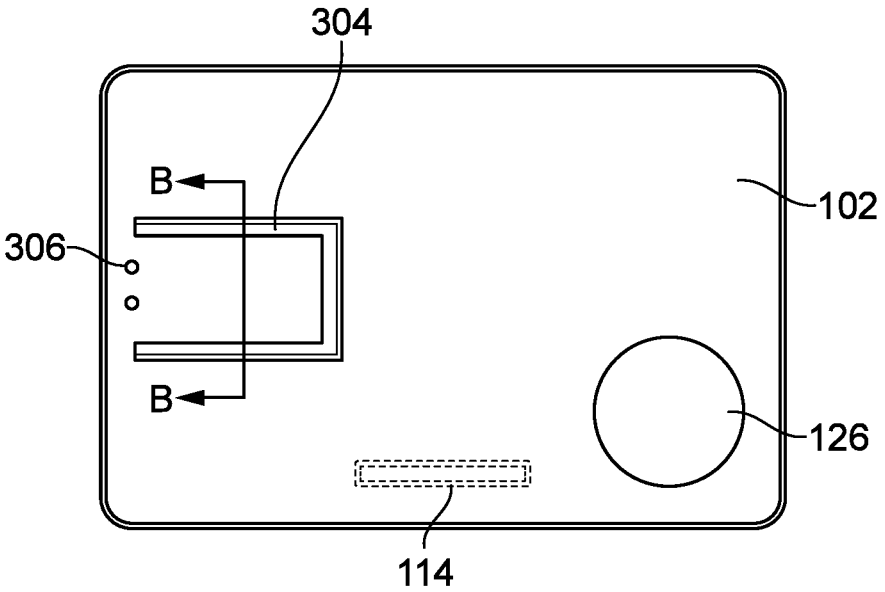
FIG. 3E exemplarily illustrates a bottom view of the tray, according to an embodiment of the present invention.
Figure 3F:
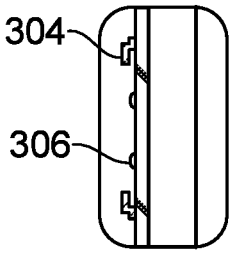
FIG. 3F is a cross sectional view of a metal plate, along a section B-B' of FIG. 3E, according to an embodiment of the present invention.
Figure 3G:
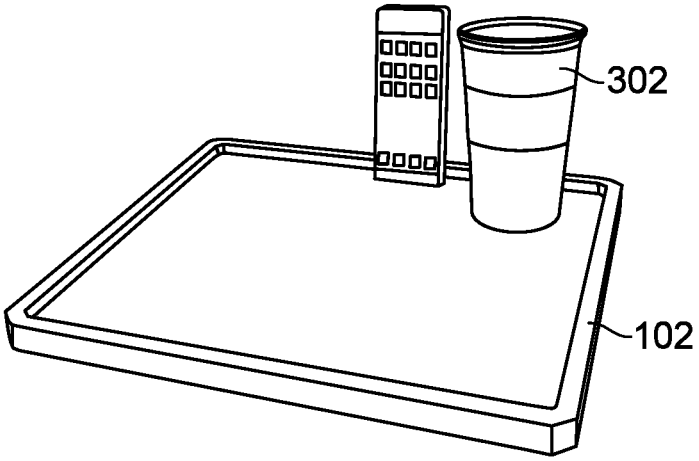
FIG. 3G exemplarily illustrates the tray holding the cup and a cell phone, according to an embodiment of the present invention.

Referring to FIG. 3E, a bottom view of the tray 102 is illustrated, according to an embodiment of the present invention. The tray 102 is molded from food grade plastic, which is BPS free, and could be machine washed followed by an air dry, fitting in with the normal concession stand serving tray cleaning processes. Referring to FIG. 3F, a cross sectional view of a metal plate 304 along a section B-B' of FIG. 3E is illustrated, according to an embodiment of the present invention. A tray receptacle accepts the metal plate 304 which allows it to slide in such a manner that the sides of the tray 102 captures it. In an embodiment, one or more buttons 306 have enough compliance to prevent the metal plate 304 from inadvertently sliding out. In an embodiment, the metal plate 304 could be easily removed for easy return of the tray 102 to the concession stand. The tray 102 could be supplied in almost any vibrant color but the most common for stadium use are any one of the standard fourteen colors, with red, black, blue, and forest green being the most popular. FIG. 3G exemplarily illustrates the tray 102 holding the cup 302 and a cell phone, according to an embodiment of the present invention.

The tray 102 of the present invention is configured to accommodate food, drink, and personal items. The adjustable table 100 is distributed with the items such as food and drinks from the concession stand. The tray 102 of the adjustable table 100 further holds the drink and items securely without spillage. The mechanism for attachment of the tray 102 to the seat 204 is simple and easy. The adjustable table 100 could be rotated with the locking mechanism at four points. The horizontal assembly 104 telescopes out and in for different size users. The adjustable table 100 could be removed and placed under the seat 204 and out of the way when finished. The slot 114 provided on the tray 102 holds the cell phone of the user. The tray 102 is retrieved after an event by the stadium or arena personnel. The adjustable table 100 of the present invention is easy and quick to attach and remove. The adjustable table 100 is made of quality and durable materials. Further, the tray 102 is available in variety of designs and colors. The tray 102 is removed by the user when finished and placed under the seat 204 for the arena personnel to retrieve after the event. The tray 102 is compact and does not interfere with other patrons in the neighboring seats. The food grade tray 102 could be machine washed, air dried, and then stacked in the concession stand for storage. Further, the riser assembly remains beneath the seat 204, and ready for the next use. The adjustable stand 100 holds the items of the viewers right in front of them allowing the viewer to enjoy the event in the stadium without worrying the placement of the expensive food and drink that was purchased for refreshment.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. An adjustable seat table assembly, comprising:

a tray having a raised edge portion extended upwardly, wherein said raised edge portion prevents items from falling off from the edge of the tray;

wherein the tray comprises:

at least one aperture provided on the tray for receiving and holding liquid food containers;

at least one slot provided on a top portion of the tray, wherein the slot is configured to securely hold at least one handheld device in a standing position;

a connector securely located on a side portion of an underside of the tray using fasteners, wherein the connector is configured to rotatably receive one end of a vertical tubing, and a horizontal tubing telescopically secured to a bottom portion of the seat via one or more brackets, wherein the horizontal tubing is configured to receive a second end of the vertical tube via an angle bracket, thereby simply and quickly assembling and disassembling the adjustable seat table to the seat by a user;

wherein a metal plate is configured to slidably receive a top portion of the connector, thereby simply and quickly assembled and disassembled the tray to the connector.

2. The seat table assembly of claim 1, wherein the tray is configured to securely support items include refreshments and food liquid containers.

3. The seat table assembly of claim 1, wherein the tray is made of food grade plastic.

4. The seat table assembly of claim 1, wherein the vertical tubing and the horizontal tubing are telescopic tubes.

5. The seat table assembly of claim 1, wherein the one or more brackets are securely positioned to the bottom portion of the seat using fasteners.

6. The seat table assembly of claim 1, wherein the one or more brackets are configured to slidably and securely receive the horizontal tubing.

7. The seat table assembly of claim 1, wherein the tray comprising a metal plate securely affixed to the side portion of the underside of the tray.

8. The seat table assembly of claim 1, wherein the tray of the seat table is securely locked to the connector at the bottom portion using one or more buttons.

9. The seat table assembly of claim 1, wherein the connector comprising a retaining plate secured to an outer ring, wherein the outer ring is slotted to accept and rotatably hold one or more spring-loaded rotation buttons.

10. The seat table assembly of claim 1, wherein the handheld device is at least any one of a smart phone, a tablet, or a personal digital assistant (PDA).

11. The seat table assembly, comprising;

a tray having a raised edge portion extended upwardly, wherein said raised edge portion prevents items from falling off edge of the tray;

wherein the tray comprises:

at least one aperture provided on the tray for receiving and holding liquid food containers;

at least one slot provided on a top portion of the tray, wherein the slot is configured to securely hold at least one handheld device in a standing position;

a metal plate securely affixed to a side portion of an underside of the tray, wherein the metal plate is configured to slidably receive a top portion of a connector, thereby simply and quickly assembled and disassembled the tray to the connector, a vertical tubing having two ends, wherein one end of the vertical tubing is securely assembled to the connector via drive pins, and a horizontal tubing telescopically secured to a bottom portion of the seat via one or more brackets, wherein the horizontal tubing is configured to receive a second end of the vertical tube via an angle bracket, thereby simply and quickly assembling and disassembling the adjustable seat table to the seat by a user.

12. The seat table assembly of claim 11, wherein the tray is configured to securely support items include refreshments and food liquid containers.

13. The seat table assembly of claim 11, wherein the tray is made of food grade plastic.

14. The seat table assembly of claim 11, wherein the vertical tubing and the horizontal tubing are telescopic tubes.

15. The seat table assembly of claim 11, wherein the one or more brackets are securely positioned to the bottom portion of the seat using fasteners.

16. The seat table assembly of claim 11, wherein the one or more brackets are configured to slidably and securely receive the horizontal tubing.

17. The seat table assembly of claim 11, wherein the tray of the seat table is securely locked to the connector at the bottom portion using one or more buttons.

18. The seat table assembly of claim 11, wherein the connector comprising a retaining plate secured to an outer ring, wherein the outer ring is slotted to accept and rotatably hold one or more spring-loaded rotation buttons.

19. The seat table assembly of claim 11, wherein the handheld device is at least any one of a smart phone, a tablet, or a personal digital assistant (PDA).

* * * * *